US009498703B2

(12) United States Patent
McCoskey et al.

(10) Patent No.: US 9,498,703 B2
(45) Date of Patent: Nov. 22, 2016

(54) ASSEMBLY KIT FOR THREE DIMENSIONAL WORKS

(71) Applicant: Stat Ventures, Inc., Dallas, TX (US)

(72) Inventors: Robert J. McCoskey, Dallas, TX (US); Daniel Padilla, Dallas, TX (US); Shyh-Min Chen, Plano, TX (US)

(73) Assignee: Stat Ventures, Inc., Dallas, TX (US)

( * ) Notice: Subject to any disclaimer, the term of this patent is extended or adjusted under 35 U.S.C. 154(b) by 245 days.

(21) Appl. No.: 13/800,563

(22) Filed: Mar. 13, 2013

(65) Prior Publication Data

US 2014/0265117 A1 Sep. 18, 2014

(51) Int. Cl.

| | |
|---|---|
| ***A63H 33/00*** | (2006.01) |
| ***A63F 9/12*** | (2006.01) |
| ***A63H 33/10*** | (2006.01) |

(52) U.S. Cl.

CPC ..... *A63F 9/12* (2013.01); *A63H 33/106* (2013.01)

(58) Field of Classification Search

USPC ..... 446/105, 108, 111, 113, 116, 117, 118

See application file for complete search history.

(56) References Cited

U.S. PATENT DOCUMENTS

| | | | | | |
|---|---|---|---|---|---|
| 1,401,057 | A | * | 12/1921 | Elliott | A47B 87/0223 108/101 |
| 1,824,682 | A | * | 9/1931 | O'Neil | A47F 5/04 108/191 |
| 1,916,634 | A | * | 7/1933 | Pajeau | 446/103 |
| 2,885,822 | A | * | 5/1959 | Onanian | 446/121 |
| 2,949,323 | A | * | 8/1960 | Moorhead | 211/175 |
| 3,205,611 | A | * | 9/1965 | Onanian | 446/89 |
| 3,224,136 | A | * | 12/1965 | Moryl | 446/100 |
| 3,455,049 | A | * | 7/1969 | Dyer et al. | 446/102 |
| 3,503,832 | A | * | 3/1970 | Umminger, Jr. | 428/33 |
| 3,518,787 | A | * | 7/1970 | Anello, Sr. et al. | 446/124 |
| 3,589,056 | A | * | 6/1971 | Glass et al. | 446/91 |
| 3,594,940 | A | * | 7/1971 | Yonezawa | 446/118 |
| 3,831,533 | A | * | 8/1974 | Kellogg | A47B 87/0215 108/101 |
| 3,975,858 | A | * | 8/1976 | Much | 446/107 |
| 3,987,579 | A | * | 10/1976 | Palenik, III | 446/118 |
| 4,069,772 | A | * | 1/1978 | Haapala | A21C 15/002 108/101 |
| 4,164,091 | A | * | 8/1979 | Lin | 446/118 |
| 4,547,160 | A | * | 10/1985 | Labelle | 434/195 |
| 4,551,110 | A | * | 11/1985 | Selvage et al. | 446/118 |
| 4,571,200 | A | * | 2/1986 | Serna | 446/85 |
| 4,764,143 | A | | 8/1988 | Gat et al. | |
| 4,895,548 | A | * | 1/1990 | Holland et al. | 446/476 |
| 4,988,322 | A | * | 1/1991 | Knudsen | 446/120 |
| 5,009,599 | A | * | 4/1991 | Mueller | 434/81 |
| 5,145,177 | A | * | 9/1992 | Wells | 273/157 R |
| 5,163,862 | A | * | 11/1992 | Philips et al. | 446/114 |
| 5,251,900 | A | | 10/1993 | Gallant | |

(Continued)

*Primary Examiner* — Melba Bumgarner
*Assistant Examiner* — Joseph B Baldori
(74) *Attorney, Agent, or Firm* — Vincent J. Allen; James Ortega; Carstens & Cahoon, LLP

(57) ABSTRACT

Kits designed to stimulate creativity, to provide exercise for fine motor skills, and to improve spatial perception. The kits may be useful as a stimulating "toy" for children to develop creativity, spatial perception and motor skills, as a therapeutic kit for the elderly or those requiring rehabilitation of fine motor skills; as a diversion to relieve stress, to create unique works for the home or office, to display photos and memorabilia, and for a host of other purposes, limited by the imagination. The kits include at least shaped components, fasteners, and a platform onto which a three-dimensional work is mounted.

16 Claims, 7 Drawing Sheets

(56) References Cited

U.S. PATENT DOCUMENTS

| | | | | |
|---|---|---|---|---|
| 5,282,767 | A | 2/1994 | Gelardi | |
| 5,310,376 | A * | 5/1994 | Mayuzumi et al. | 446/107 |
| 5,322,466 | A * | 6/1994 | Bolli et al. | 446/121 |
| 5,372,450 | A * | 12/1994 | Blodgett | 403/171 |
| 5,460,561 | A | 10/1995 | Dahlgren | |
| 5,779,515 | A * | 7/1998 | Chung | 446/90 |
| 5,800,239 | A * | 9/1998 | Cohen | 446/85 |
| 5,853,313 | A | 12/1998 | Zheng | |
| 5,860,650 | A | 1/1999 | Scobbie et al. | |
| D406,620 | S | 3/1999 | Everdell | |
| 5,876,262 | A * | 3/1999 | Kelly et al. | 446/118 |
| 5,904,606 | A * | 5/1999 | Zimmer et al. | 446/108 |
| 5,916,006 | A | 6/1999 | Ganson | |
| 5,938,496 | A | 8/1999 | Zheng | |
| 5,954,562 | A * | 9/1999 | Chen | 446/122 |
| 6,059,631 | A | 5/2000 | Maddock | |
| 6,315,628 | B1 * | 11/2001 | Quercetti | 446/128 |
| 6,402,581 | B1 | 6/2002 | Podgaiz | |
| 6,443,796 | B1 * | 9/2002 | Shackelford | 446/91 |
| 6,461,215 | B1 * | 10/2002 | Kunz et al. | 446/107 |
| 6,475,055 | B1 * | 11/2002 | Javer et al. | 446/108 |
| 6,641,453 | B1 | 11/2003 | Morales et al. | |
| 6,761,354 | B2 | 7/2004 | Pavlovits | |
| 7,267,598 | B2 | 9/2007 | Glickman | |
| 7,469,898 | B2 | 12/2008 | Forakis | |
| 7,510,457 | B2 | 3/2009 | Hussa-Lietz | |
| 7,517,270 | B2 * | 4/2009 | Marzetta | 446/122 |
| 7,735,429 | B2 | 6/2010 | Meissen | |
| 7,736,211 | B2 * | 6/2010 | Marzetta | 446/122 |
| 8,079,890 | B2 * | 12/2011 | Seligman | 446/124 |
| 8,113,518 | B2 | 2/2012 | Rosen | |
| 8,205,885 | B2 | 6/2012 | Latour et al. | |
| 8,282,103 | B2 * | 10/2012 | Stanoch | 273/289 |
| 8,986,012 | B1 * | 3/2015 | McGee | 434/211 |
| 2002/0168916 | A1 * | 11/2002 | Axelrad | 446/109 |
| 2006/0135032 | A1 * | 6/2006 | Wijerama | 446/108 |
| 2009/0298385 | A1 * | 12/2009 | Brinckerhoff | 446/487 |
| 2013/0203315 | A1 * | 8/2013 | Scanzon | 446/75 |
| 2014/0265117 | A1 * | 9/2014 | McCoskey et al. | 273/157 R |

* cited by examiner

ASSEMBLY KIT FOR THREE DIMENSIONAL WORKS

BACKGROUND

1. Field of the Invention

The invention relates to kits that may be assembled into three dimensional works of a virtually infinite variety of shapes, while requiring exercise of creativity and fine motor skills, and in particular to works that are multi-layered and created of separate shaped parts connected together to form the work.

2. Description of the Related Art

In the past, many kits have been developed and commercialized, and the most common, perhaps, is the simple "jig saw" puzzle. Such puzzles are generally in the form of a multiplicity of pieces, that when appropriately assembled, form a two dimensional picture or design. These puzzles can be manufactured by printing a design or picture onto a fairly stiff paperboard, and then incising the paperboard in a predetermined fashion to cut it into a multiplicity of pieces that fit together. The pieces are then separated and packaged. The consumer buys the packaged jig saw puzzle, and the challenge is to reassemble the pieces to produce the original work, whether a design, or a picture.

U.S. Pat. No. 8,113,518 to Rosen asserts a multi-dimensional puzzle, of the "jig saw" variety, and shows a two-layered assembled puzzle in FIGS. 10 and 11, in which the assembled upper jig saw puzzle layer is raised on mounting blocks and located above the lower assembled jig saw puzzle layer. The pieces of the puzzle, as presented to the user, are preformed and are not created by the user. U.S. Pat. No. 5,860,650 also provides a three dimensional puzzle of the jig saw type. Each piece is precut into a predetermined shape, as with all jig saw puzzles, and has a predetermined place where it fits into the design, to form the final three-dimensional assembled puzzle structure. As with the standard jig saw puzzle, the user's creativity is not tested in either U.S. Pat. Nos. 8,113,518 or 5,860,650. Rather, the jig saw puzzle challenges the user's ability to match shapes and colors to (re)create the assembled puzzle structure.

A variety of kits are described in the patent literature. These have in common the use of standard provided shaped parts, or components, that may be assembled together to create either a particular shape, or a shape that is amenable to being formed, based on the particular uniform shape of the components. U.S. Pat. No. 6,059,631 asserts that its "interlocking building blocks" of particular shapes may be assembled to form polyhedrons or other geometric shapes. U.S. Pat. Nos. 5,853,313 and 5,938,496 assert that its construction system uses a deformable section to interconnect provided pre-shaped component parts together. But, as with virtually all other building block systems, the shapes of the blocks are predetermined. The consumer's creativity may be challenged to some extent in that a variety of "finished assemblies" may be made. But ultimately the predetermined shapes of the blocks do impose limitations on the potential range of finished assembly shapes.

SUMMARY

The following is a summary of some aspects and exemplary embodiments of the present technology, of which a more detailed explanation is provided under the Detailed Description section, here below.

Exemplary embodiments of the present kit are designed to stimulate creativity, to provide exercise for fine motor skills, and to improve spatial perception. The kits may be useful as a stimulating "toy" for children to develop creativity, spatial perception and motor skills, as a therapeutic kit for the elderly or those requiring rehabilitation of fine motor skills; as a diversion to relieve stress, to create unique works for the home or office, to display photos and memorabilia, and for a host of other purposes, too numerous to detail, only limited by the imagination.

An exemplary embodiment provides a kit for assembly of a variety of shaped components into a three dimensional work. The kit includes a plurality of selected shaped components that have a length, a width and a thickness, and a through-hole that has a perimeter completely within the component and penetrating through the thickness of each component. In addition, the kit includes a plurality of press-twist fasteners sized to fit through the through-hole of the shaped components, and configured to lock the selected shaped components together into an assembled three dimensional work according to a predetermined design, or according to a design created by a user of the kit. Also included is a plurality of spacers that each have a central through bore configured to receive a fastener, such as a press-twist fastener. Each spacer has structure for engaging a shank portion of a press-twist fastener, and each has a support surface to support shaped components in the three dimensional work. The kit also includes a platform that has through holes to receive fasteners to mount the three dimensional work to the platform.

Optionally, the plurality of components of the exemplary kit are white, and the kit also has coloring materials, in a variety of colors, suitable for applying color to the plurality of shaped components. Further, the selected shaped components may optionally be transparent or translucent, and the kit may include light emitting diodes (LEDs) and optical fiber. The optical fiber may guide light from the light emitting diodes to at least some of the plurality of shaped components in the assembled three-dimensional work to provide a colorful, back-lit three dimensional work. The kit may also include a controller for creating light patterns with the LEDs. The kit may also have a sound chip that provides an audio accompaniment to the light display, and that might be activated by a motion sensor, light sensor, or sound sensor, also provided as an optional part of the kit. As to the press-twist fasteners, these may optionally be configured to nest within each other end-to-end to thereby provide combination fasteners of fixed length increments. Optionally, to exercise fine motor skills, a first end of a first fastener may frictionally engage a second end of a second fastener, and the first and second ends may maintain engagement upon twisting the first fastener relative to the second fastener, with appropriate force.

In a further exemplary embodiment, there is provided a method of making a three dimensional work from a plurality of components of selected shapes. The method includes the step of selecting a plurality of pre-cut components of predetermined shapes having a through hole, or selecting and cutting raw material into a plurality of desired shapes to create components having a through hole. It also has the step of assembling the components together into a three dimensional work, by a methodology that includes putting press-twist fasteners through the through holes in the components, and using spacers to support components at different levels and to separate the components. Another step is mounting the three dimensional work onto a platform.

The exemplary method above may optionally include several other steps, such as creating designs on some of the components; applying color to some of the components;

applying light via fiber optics to at least some of the components; controlling the applied light in a light display pattern; playing an audio file along with the step of controlling in a light display pattern; and sensing motion nearby the three dimensional work and initiating sound, or a light display or both. In addition, the method may include using the press-twist fasteners which require the exercise of fine motor skills, such as the controlled unguided insertion of an end of a first fastener into a through hole of a component, or the controlled unguided insertion of an end of a first fastener into an end of a second fastener, and the twisting of the first fastener relative to the second fastener with appropriate force sufficient to secure the two fasteners together, without breaking either.

Moreover, the exemplary method may include creating designs on some of the shaped components. The method may also include applying color to some of the components. In addition, it may include mounting a photograph to the platform, and mounting the three dimensional work such that the photograph is viewable to an observer. If lighting is applied to the work, the method may include controlling the applied light in a light display pattern. In that case, it may also include playing an audio file along with the step of controlling in a light display pattern. Another embodiment may include sensing motion nearby the three dimensional work and initiating sound, or a light display or both.

Another exemplary embodiment provides an assembled three dimensional work comprised of a plurality of components. The assembled work has a plurality of selected shaped components, and a plurality of fasteners lock the plurality selected shaped components together into an assembled three dimensional work. The shaped components are assembled into a plurality of levels, as a multi-level work where selected components are present at the levels. Optionally, the multi-level work may be mounted to a platform configured, for example with through holes to receive fasteners, to mount the multi-level work thereto to create a three-dimensional work with multiple levels of components.

BRIEF DESCRIPTION OF THE DRAWINGS

The foregoing aspects and many of the attendant advantages, of the present technology will become more readily appreciated by reference to the following Detailed Description, when taken in conjunction with the accompanying simplified drawings of exemplary embodiments. The drawings, briefly described here below, are not to scale, are presented for ease of explanation and do not limit the scope of the inventions recited in the accompanying patent claims.

DETAILED DESCRIPTION

The following non-limiting detailed descriptions of examples of embodiments of the invention may refer to appended Figure drawings but are not limited to the drawings, which are merely presented for enhancing explanations of features and aspects of the inventive technology. In addition, the detailed descriptions may refer to particular terms of art, some of which are defined herein, as appropriate and necessary for clarity.

The present kits present an opportunity to create an almost infinitely variable range of "three-dimensional works," depending upon the shape of the components, any "design" imposed on the components, the number of "levels," of the three-dimensional structure, and the user's creative input. In addition, the kits present an opportunity to exercise or rehabilitate the fine motor skills of individuals who may be at risk of losing these skills, or who may be recovering from injury or illness that impaired these skills. Further, the kits also promote shape-recognition and spatial perception. Therefore, the kits may also be used to assist those in need of improving these characteristics, or as an educational toy for children to develop these characteristics as well as stimulating creativity. Since the kits contain small parts, such as the fasteners and spacers, the kits are not recommended for children under the age of 4 years. The present kits may also be used as a recreational diversion to relieve stress, to create unique works for the home or office, to display photos and memorabilia, and for a host of other purposes, too numerous to detail, only limited by the imagination.

In the specification and claims, the term "three-dimensional work" includes an assembled three dimensional structure that may be of any shape or design.

In the specification and claims, the term "levels" when referring to shaped components in a three dimensional work, includes that the shaped components are arranged so that some are elevated above others. In some exemplary embodiments the shaped components may be planar and the levels may be parallel planes, but the levels may also include planes that are angled so that the planes may intersect, if extended.

In the specification and claims, the term "design" when referring to designs on shaped components, especially white-colored shaped components, may include any pattern, or a solid color.

Figure 1:
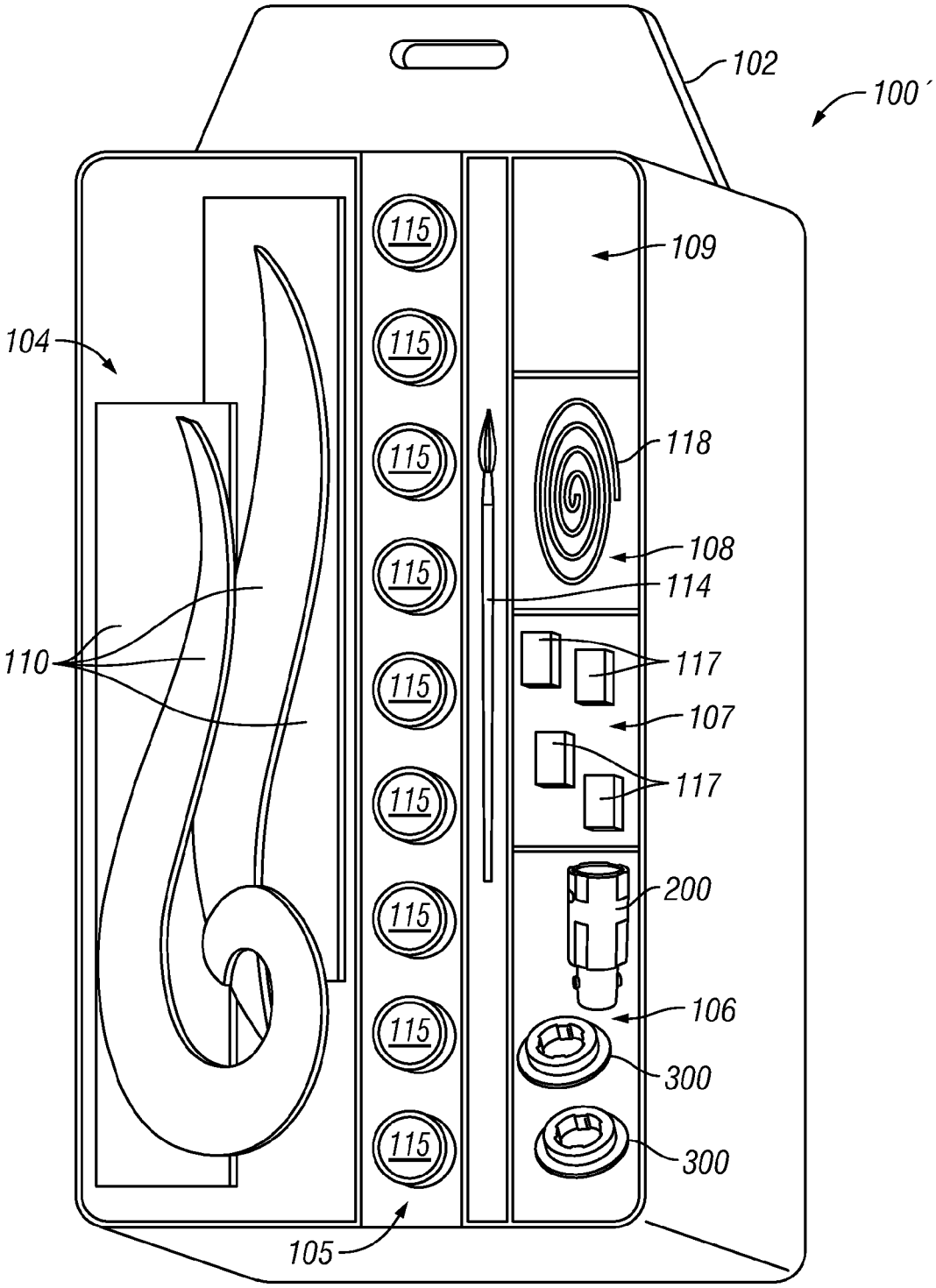
FIG. 1 is an illustration in perspective view of an exemplary embodiment of a kit for assembling three-dimensional works.

Referring to FIG. 1, the illustrated exemplary kit 100' is presented, for example, in a blister pack 102 that has several compartments, for the sake of convenience. A first compartment 104 contains a variety of shaped components 110 that are assembled, as explained below, to make a three-dimensional work. The illustrated exemplary blister pack 102 also has a compartment 105 that contains a series of colorants, such as paint containers 115, along with paint brushes 114.

Another compartment 106 contains fasteners 200, spacers 300 and end caps 350. Compartment 107 may contain, for example, electronic components 117, such as sound chips, LEDs, batteries, and a range of other components, limited only by the creative imagination that may be added to enhance the basis kits. Compartment 108 may include other items, for example, optical fiber 118. Compartment 109 may contain a further range of other components, limited only by the creative imagination that may be added to enhance the basis kits. A compartment at the bottom of the blister pack (not shown) may contain the platform 150 to which the three-dimensional work of the assembled kit components may be mounted to form a mounted three-dimensional work.

Figure 2A:
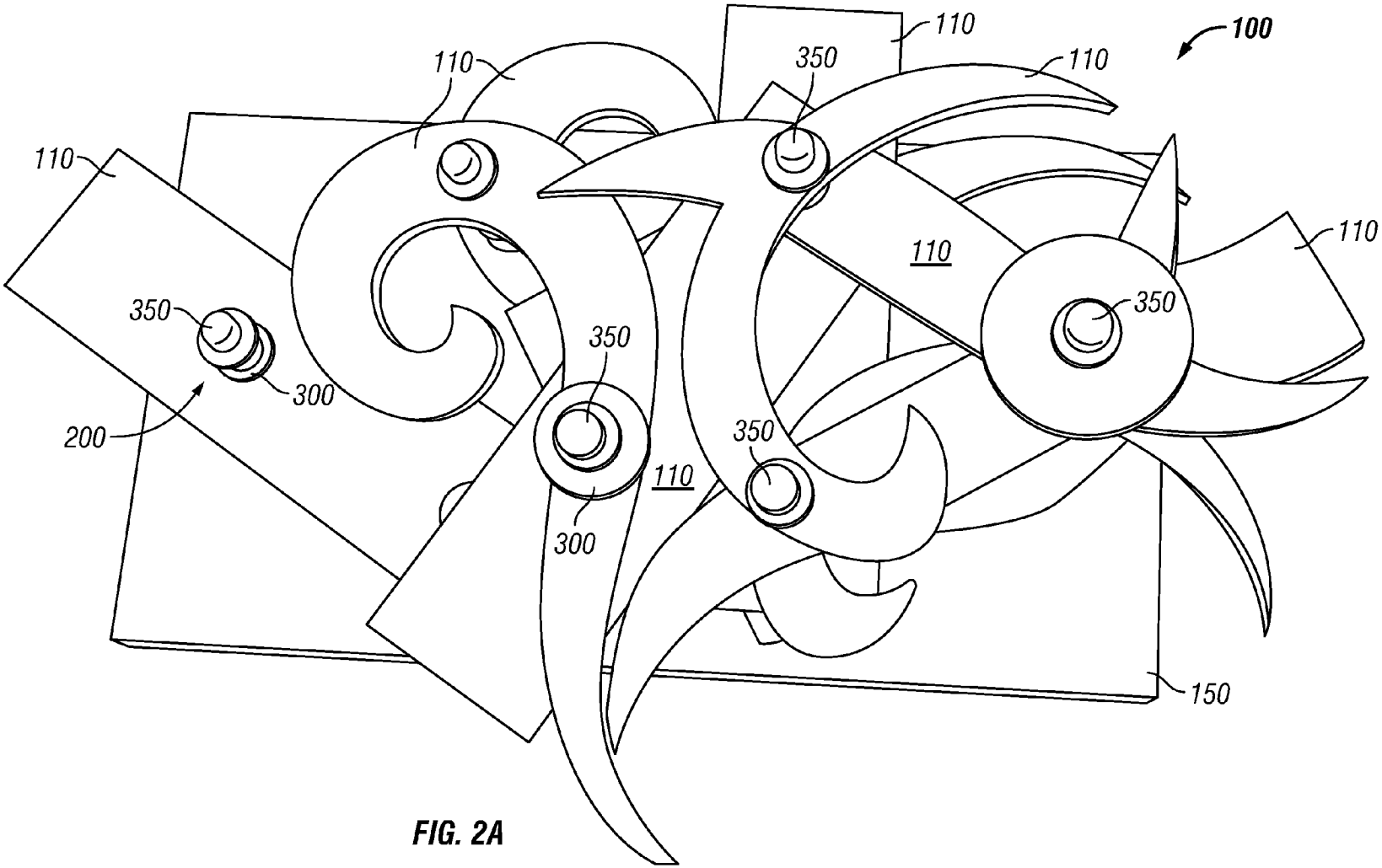
FIG. 2A is a top view of an exemplary embodiment of a kit assembled into an example of a three-dimensional work.
Figure 2B:
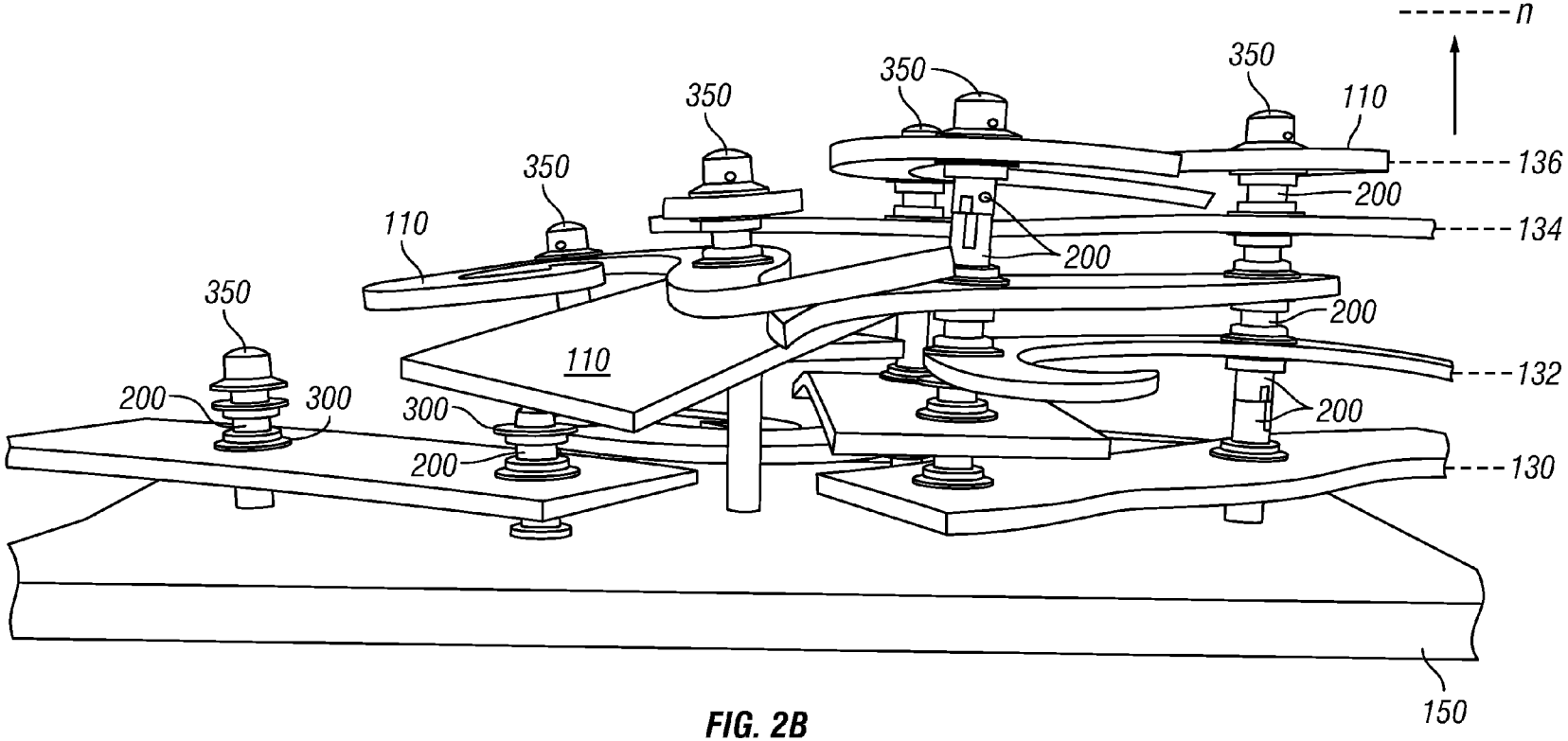
FIG. 2B is another view of the illustration of FIG. 2A of an exemplary embodiment of a kit assembled into an example of a three-dimensional work.

Referring to FIGS. 2A and 2B, these depict an example of a three-dimensional work 100 assembled from a kit, such as the exemplary kit 100'. The three-dimensional work 100 includes several exemplary shaped components 110 that are arranged on levels 130-136, as shown. Of course, more levels or fewer levels may be used and the multi-level structure may extend upward for many more levels, up to layer n, where n exceeds 15. The levels 130-136 are set apart by spacers 300 that are associated with fasteners 200, as explained below, in more detail. The exemplified assembled multi-level structure is shown mounted to a platform 150 to form the mounted three-dimensional work 100.

The shaped components 110 may be provided in a kit 100', and the shapes of the components in the kit may vary, depending upon the kit selected. A variety of shaped components 110 may also be provided separately, for use with other components of an originally-purchased kit. In addition, the shaped components may be plain white as provided in the kit, or may be colored or have a design imprinted. Moreover, the kit may have "blanks" (or sheets) of a material that the kit-assembler (or "user") can cut according to his or her own creative imagination to create shaped components. Further, a design may be applied to these created shaped components through use of a coloring medium, for example. Moreover, other decorative materials may also be applied to any shaped components, such as colored or metallic tinsel, metallic foil, glitter, rhinestones, and the like, without limitation. Moreover, decals having a motif may also be provided in the kit (or may be pre-applied to the shaped components in the kit) to create a three-dimensional work with a motif.

The shaped components may be fabricated from a variety of materials, as long as these are sufficiently durable for the handling entailed in assembling the three-dimensional work. For example, stiff paper or paperboard, metalized plastic, transparent or translucent plastics, foamed plastics and other plastic materials. An exemplary material includes a light, foamed plastic material, or another material, such as but not limited to, Eucaboard (widely available commercially) that is easily cut to shape, and durable, and that can be provided either as a white shaped component for the kit-assembler to create a design thereon, or as pre-colored, or having a design already applied, as provided in the kit.

An exemplary kit may further include light emitting diodes (LEDs) and optical fiber, as explained above. In the example of such a kit, it may be advantageous to use shaped components of transparent or translucent plastic. Optical fiber may convey light from the LEDs to these shaped components to provide light which may shine through and light up the shaped components to create a three-dimensional work that glows according to where the optical fiber is arranged. Thus, a light design is superimposed on the three-dimensional design. The optical fiber may be adhered to selected ones (or all) of the shaped components. Alternatively, to more challengingly exercise and develop fine motor skills of the kit-assembler, the shaped components may have narrow passages into which the optical fiber may be threaded. Any suitable power supply may be provided, for example power from a wall outlet (using such voltage and amperage modification, as necessary) or a battery, which may optionally be enclosed within a cavity in the platform, to be unobtrusive.

An exemplary kit may also include a motion sensor and a programmable sound generator (PSG) or "sound chip." When the three-dimensional work is displayed, and the motion sensor detects a nearby movement, for example an approaching person, and activates the sound chip to play a tune, call out a greeting, or provide some other auditory stimulus. Of course, a kit may also have a sound chip without a motion sensor. The chip may be activated manually, for example by a switch or button, or remotely.

FIGS. 3A and 3B and FIGS. 7A, 7B and 7C illustrate examples of fasteners 200 and 201, respectively, that may be used with the shaped components to create three-dimensional works, exemplified by work 100 in FIGS. 2A and 2B. The exemplified fasteners 200, 201 referred to herein as "press-twist" fasteners, are configured to nest within each other to effectively create longer fasteners and facilitating the assembly of a multi-level work, while minimizing the number of different pieces required in the kit. These fasteners 200, 201 also develop and train the fine motor skills of the kit-assembler by requiring unguided insertion of one fastener into an axial bore of another fastener for a friction fit, and requiring controlled twisting of one fastener relative to the other, to lock them together.

Figure 3A:
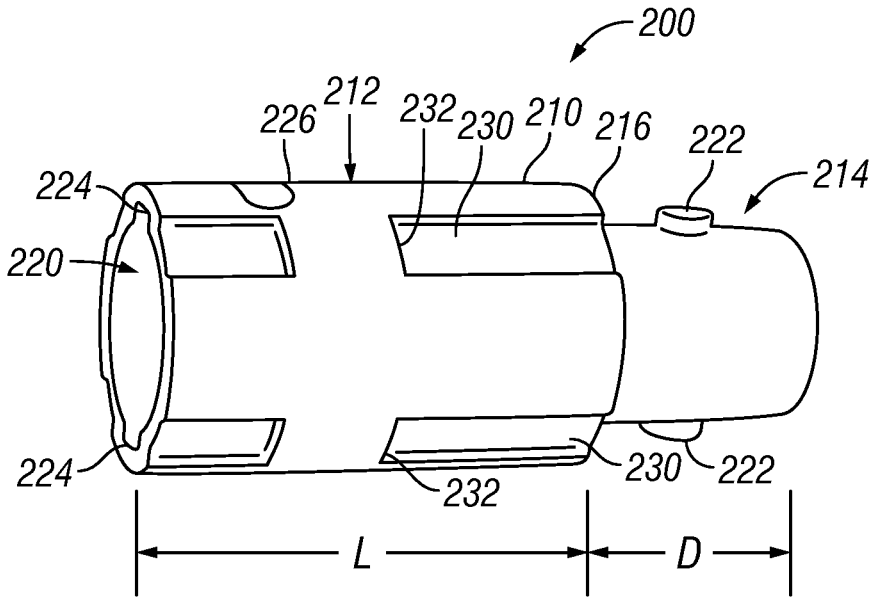
FIGS. 3A and 3B are illustrations of alternative views of an exemplary embodiment of fasteners that may be used to assemble a kit into a three-dimensional work.
Figure 3B:
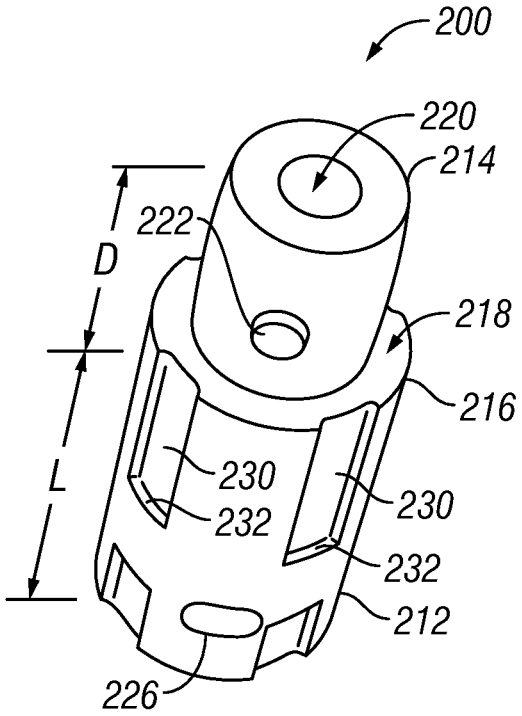

As can be seen in FIGS. 3A and 3B, the fastener 200 has a substantially cylindrical body 210 that has a first portion 212 having a larger diameter than the second portion 214, with a shoulder 216 having a ledge 218 at the intersection of the first and second portions. The portion 214 is sized and configured and sized to fit snugly, in a friction-fit, within a central through bore 220 of another identical fastener (not shown) at the first portion 212 of that other fastener, so that once connected, force is required to pull the fasteners apart due to the tightness of the friction fit. The nubs 222 extending radially out from the outer surface of portion 214, on opposite sides of portion 214, each engage a longitudinally extending slot 224 within the through bore 220. The two fasteners are then locked together by twisting one around its central axis relative to the other. This twisting causes the nubs 222 to engage and slide into a circumferential slot 226 that extends from each of the slots 224. Once the nubs 222 engage the slots 226, the two fasteners are locked together. Thus, initially the fasteners are "pressed" together by axial force and held by friction-fit, and then they are "locked" together by a rotating or twisting force.

The length of the first portion 212 of fastener 200 is L. It is clear that locking two fasteners together increases the overall length of the combined fastener by a length=L. Thus, locking fasteners together, end to end, increases the length by an increment L for each fastener added. Linking n fasteners together increases the length by (n−1) L. This has implications for the levels created in FIG. 1, since each level is potentially separated from nearest levels by a distance that is a multiple of L.

Figure 4A:
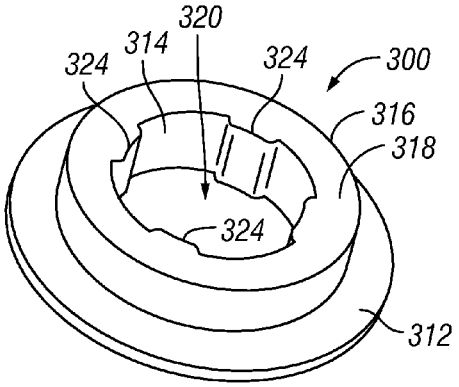
FIGS. 4A and 4B are illustrations of alternative views of an exemplary embodiment of a spacer that may be used in assembling a kit into a three-dimensional work.
Figure 4B:
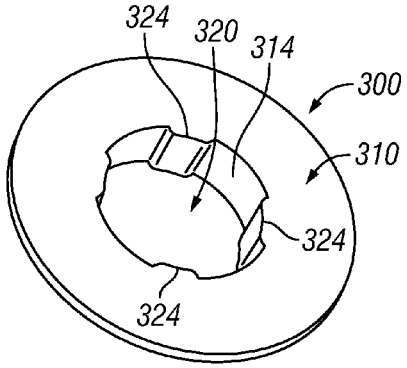
Figure 6:
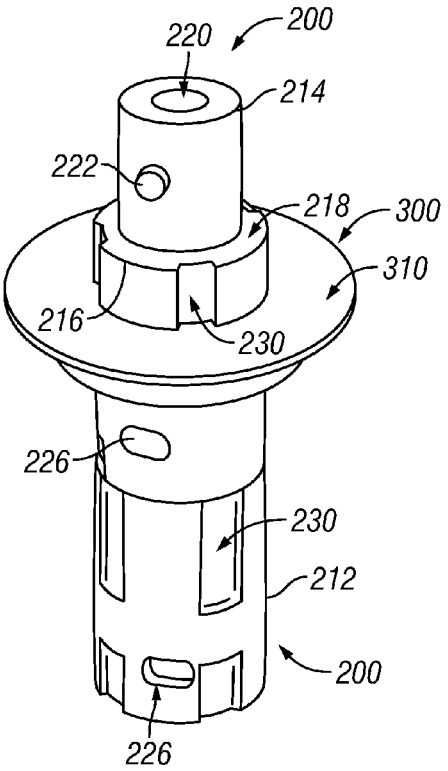
FIG. 6 illustrates two of the exemplary fasteners of FIGS. 4A and 4B assembled into an extended composite fastener.

FIGS. 4A and 4B show views of an example of a spacer 300 that may be used in conjunction with the example of a fastener 200, described above. The exemplary spacer 300 is of circular design, although any shape may be useful. It has a cylindrical sidewall 316 extending up from a circular surface 312. The cylindrical wall 316 is capped around its circumference with a ring-shaped, flat top 318. Under the circular surface 312 is a round flat, circular support surface 310. A central bore 320 extends through the support surface 310 and exits through the top of the spacer 300, surrounded by an inner wall 314 of the ring-shaped top 318. The central bore 320 is sized to receive cylindrical portion 212 of fastener 200, but is too small to receive portion 212, unless the fastener 200 enters the bore 320 such that the inwardly extending bore protrusions 324 engage the side grooves 230 of the fastener. Thus, spacer 300, when it engages with fastener 200, as depicted in FIG. 6, rests securely on the lower edges 232 of grooves 230, with spacer support surface 310 uppermost. Spacer 300 cannot move further downward. A shaped component may be manipulated such that it's through hole fits over the upper end of fastener 200, and the shaped component rests on the support surface 310. A portion of the end of the portion 212 of the fastener 200 extends beyond the thickness of the shaped component, and may be supplied with an end cap 350 or another fastener may be locked onto it to create a further level of the three-dimensional work.

Figure 5A:
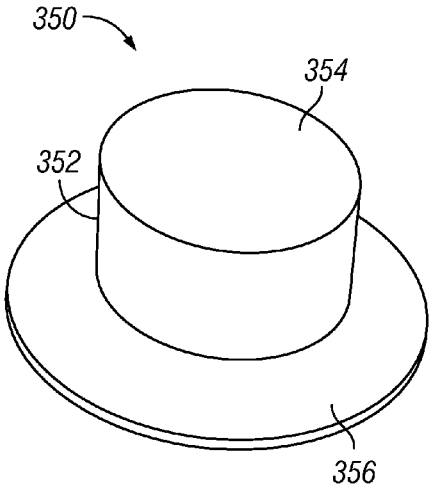
FIGS. 5A and 5B are illustrations of alternative views of an exemplary embodiment of an end cap that may be used in assembling a kit into a three-dimensional work.
Figure 5B:
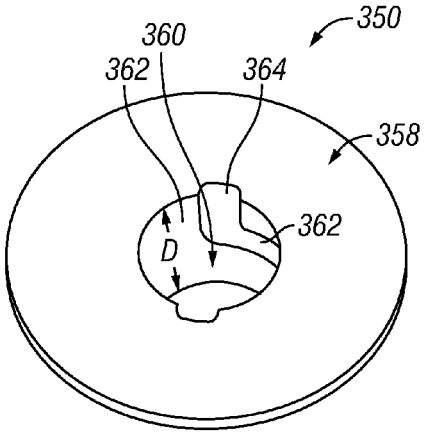

FIGS. 5A and B show views of an example of an end cap 350 that may be used to top off or cover exposed ends of a fastener 200, after all levels of structure along that fastener is completed. Thus, the example of an end cap depicted has a substantially cylindrical shape, although other shapes may be used, with a cylindrical sidewall 352 topped with a circular cover 354, although many fanciful and creative finials may be added to the top of the end cap for decorative effect. The finial, not depicted, may be part of the end cap 350, or may be an additional component that fits onto the end cap, for example in a press-fit or a press-twist fit. The sidewall 352 is surrounded by a circular outward extending upper surface 356. On the underside of the end cap 350, the base 358 has a surrounding surface coextensive with upper surface 356. The surface of base 358 has a central bore 360 that extends into and is surrounded by the sidewall 352, and terminates under cover 354. Bore 360 has a cylindrical sidewall 362 that includes two L-shaped grooves 364, located opposite each other. The L-shaped grooves each have one end extending to the undersurface 358, and are sized to receive the nubs 222 extending out from the fastener portion 214. The nubs 222 enter the L-shaped grooves 364 and are stopped by the right angled base of the L-shape. The end cap 350 is then twisted or rotated such that the nubs enter the laterally extending portion 362 of the L-shape. This locks the end cap to the fastener. Removal of the end cap 350 requires first counter rotation and then pulling of the end cap from the fastener portion 214. The depth D of the bore 360 may optionally be sized to correspond to the length of the portion 214. The depth D should however be sufficient to permit engagement of the nubs 222 with the L-shaped grooves 364.

Figure 8:
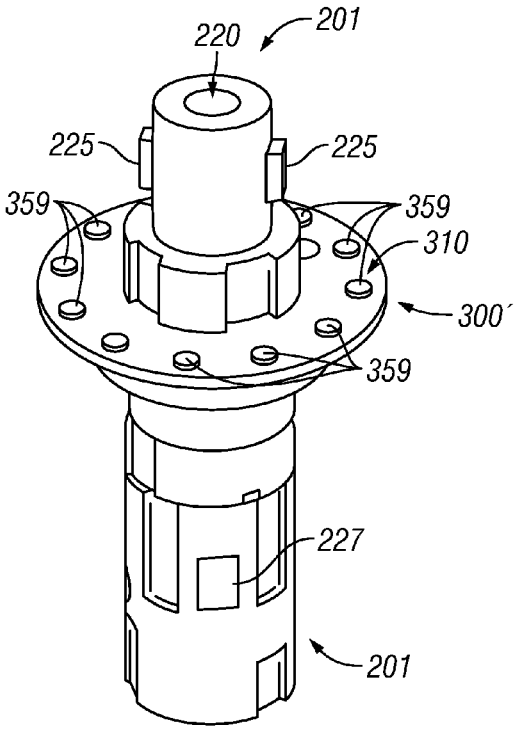
FIG. 8 illustrates two of the exemplary fasteners of FIGS. 7A, 7B and 7C assembled into an extended composite fastener.
Figure 7A:
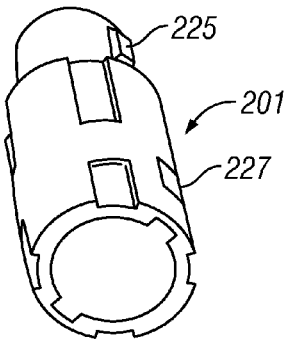
FIGS. 7A, 7B and 7C are illustrations of alternative views of another exemplary embodiment of fasteners that may be used to assemble a kit into a three-dimensional work
Figure 7B:
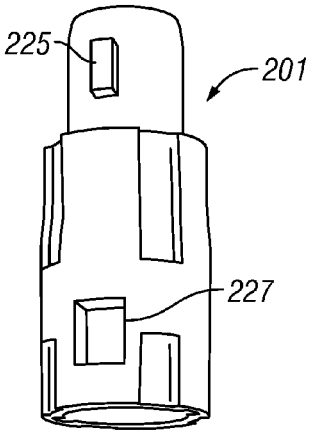
Figure 7C:
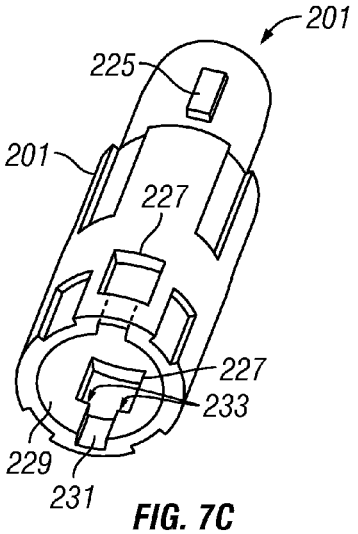

Another exemplary embodiment of a fastener 201 is shown in FIGS. 7A, 7B and 7C. This embodiment has a pair of longitudinal keys 225 in place of the nubs. Moreover, instead of internal grooves that receive the nubs, the fastener has windows 227 that receive the keys 225. Thus, the end 214 of the fastener is pressed into the bore 220 of portion 212 of another fastener. To do this, the keys 225 each slide within a groove 231 extending from the inner circumferential edge 229 of bore 220 to the window 227, until they reach the window, into which they extend, at least partially. At this point, the fasteners can be separated from each other by axial opposed pulling force. When the fasteners 201 are twisted appropriately relative to each other by a few degrees, such as 5 to 15 degrees, the keys no longer line up or "register" with the grooves 231. This is illustrated in FIG. 8, which also shows a spacer 300' with gripping protrusions 359 on its upper surface that engage a shaped component that it will support, in the same way as explained above with respect to FIG. 6. The lower edges of the keys 225 are now against the side lower edges 233 of windows 227, which lower edges act as stops. As a result, the "key 225 and stop 233" mechanical lock prevent the fasteners from being pulled apart. Removal requires first twisting one fastener relative to the other to move the keys 225 from engagement with the stops 233, lining the keys up with grooves 231, then pulling the fasteners apart with axially applied pulling force.

Figure 9:
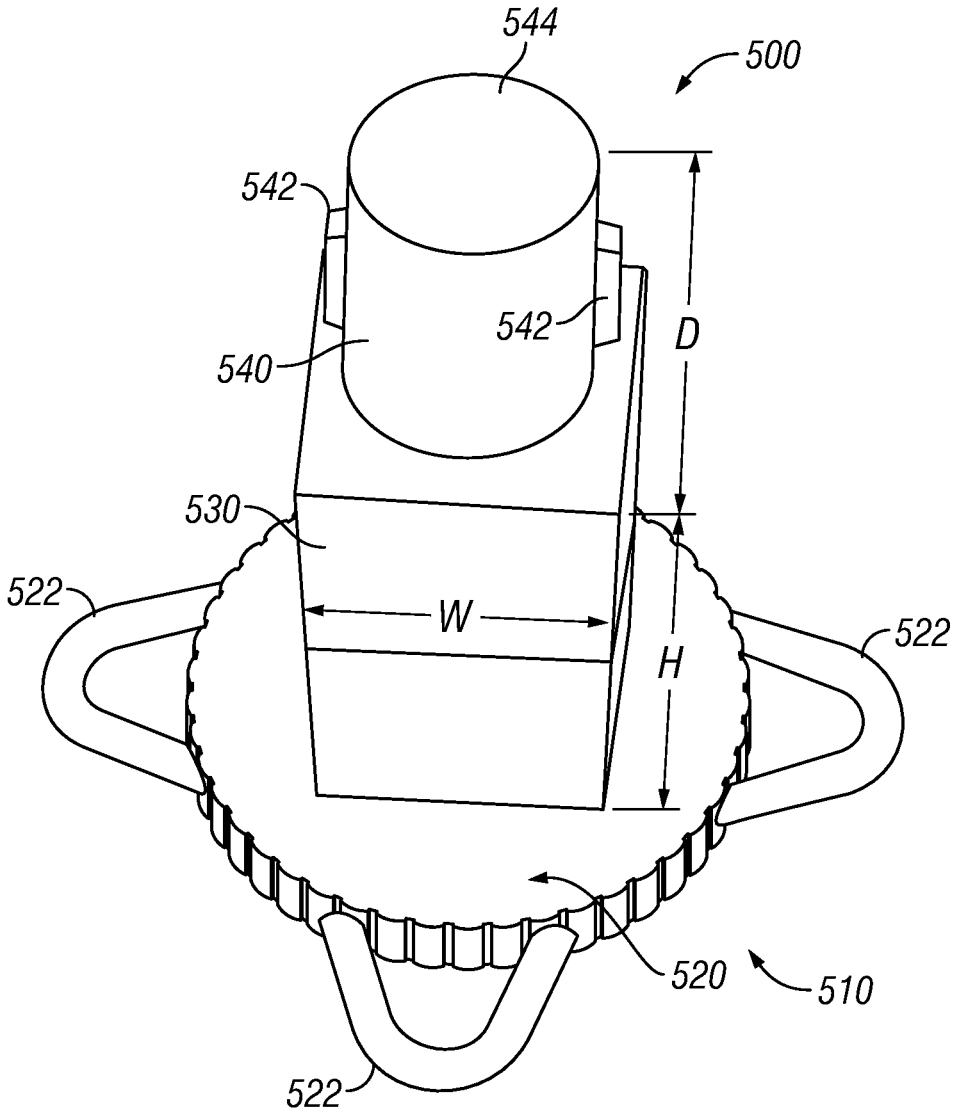
FIG. 9 is an illustration depicting an example of a non-circular cross section fastener that may be inserted into a platform to prevent rotation in assembling a kit into a three-dimensional work.

FIG. 9 shows an exemplary embodiment of a fastener having a non-circular cross section. Such a fastener 500 may be inserted into a bore, such as a bore in the platform to which a three dimensional work is to be mounted, to enhance stability of the mounting. Using a non-circular cross section fastener prevents rotation of the fastener within the bore in which it is received. As shown, this particular example has a square cross section, with each side having a length W. Of course, other geometric shapes, whether symmetric or not, may also be useful, such as a hexagonal, octagonal, trapezoidal, elliptical, and the like non-circular cross sectional shapes. The upper portion 540 may have a length D, as with the other fasteners, for ease of kit design. The lower portion 530 may have a length H, corresponding substantially to the thickness of the platform 150 through which the fastener will extend. The upper portion 540, as depicted for this example, is capped 542 and has rectangular keys 542 extending on opposite sides, similar to that of fastener 201. The fastener 500 has a base 510 that has a flat upper surface 520 that presses against an underside of the platform in the assembled three-dimensional work. Optionally, the fastener may be equipped with small gripping handles 522, to facilitate grasping and maneuvering of the fasteners into position. This also exercises fine motor skills. In addition the gripping handles 522 also facilitates hanging of the completed work by twine or fine wire that may be threaded through the handles 522, thereby also exercising fine motor skills of the user.

While examples of embodiments of the technology have been presented and described in text and, in some examples, also by way of illustration, it will be appreciated that various changes and modifications may be made in the described technology without departing from the scope of the inventions, which are set forth in, and only limited by, the scope of the appended patent claims, as properly interpreted and construed.

ADDITIONAL DESCRIPTION

The following clauses are offered as further description of the disclosed invention.

1. An assembled three dimensional work comprised of a plurality of components, the three dimensional work comprising:
   - a plurality of selected shaped components, each component having a length, a width and a thickness;
   - a plurality of fasteners locking the plurality selected shaped components together into a multi-level work, where shaped components are assembled into a plurality of levels; and
   - a platform having to which the multi-level work is mounted.
2. The kit according to any proceeding clause, wherein:

each of the plurality of selected shaped components has a through-hole having a perimeter completely within the component and penetrating through the thickness of each component;

fasteners of the plurality of fasteners, are sized to fit through the through-hole of a shaped component, and configured to lock the selected shaped components;

a plurality of spacers, the spacers each having a central through bore configured to receive a press-twist fastener, each spacer comprising structure engaging a shank portion of a fastener, the spacers each having a support surface to support shaped components in the multi-level work.

3. The kit according to clause 2, wherein the plurality of components are white and further comprising a plurality of coloring materials suitable for applying color to the plurality of shaped components.

4. The kit according to clause 2, wherein the selected shaped components are transparent or translucent.

5. The kit according to clause 4, further comprising light emitting diodes and optical fiber, the optical fiber carrying light from the light emitting diodes to at least some of the plurality of shaped components in the assembled three dimensional work.

6. The kit according to clause 5, further comprising a controller programmed to play light displays via the light emitting diodes 7. The kit according to clause 6, further comprising a sound chip providing an audio accompaniment to the light display.

8. The kit according to clause 2, further comprising any one or more of a sound chip, a sound sensor and a motion sensor, the motion or sound sensor activating the sound chip in the assembled three dimensional work.

9. The kit according to any preceeding clause, further comprising base fasteners configured to secure the three dimensional work to the platform, the base fasteners having a non-circular cross section.

10. The kit according to clause 2, wherein the plurality of fasteners are configured to nest within each other end-to-end to thereby provide combination fasteners of fixed length increments.

11. The kit according to clause 10, wherein the fasteners have a cylindrical shape with an elongate shank portion, the shank portion having a first structure on an upper portion configured to engage mechanically with a second structure on a lower portion of a like fastener.

12. The kit according to clause 11, wherein a first end of a first fastener frictionally engages a second end of a second fastener, and the first and second ends are mechanically locked together upon twisting the first fastener relative to the second fastener, with appropriate force.

13 A method of making a three dimensional work from a plurality of components of selected shapes, the method comprising the steps of:

selecting a plurality of pre-cut components;

assembling the components together into a three dimensional work, by putting fasteners through the through holes in the components, and creating multiple levels that each include at least one shaped component; and mounting the three dimensional work onto a platform.

14. The method according to clause 13 further comprising creating designs on some of the components.

15. The method according to clauses 13-14, further comprising applying color to some of the components.

16. The method according to clauses 13-15, further comprising mounting a photograph to the platform, and mounting the three dimensional work such that the photograph is viewable to an observer.

17. The method according to clauses 13-16, further comprising applying light via fiber optics to at least some of the components.

18. The method according to clause 17, further comprising controlling the applied light in a light display pattern.

19. The method according to clause 18, further comprising playing an audio file along with the step of controlling in a light display pattern.

20. The method according to clauses 13-19, further comprising sensing motion nearby the three dimensional work and initiating sound, or a light display or both.

21. The method according to clauses 13-20, wherein using the press-twist fasteners requires using fine motor skills, including controlled unguided insertion of an end of a first fastener into a through hole of a component; or controlled unguided insertion of an end of a first fastener into an end of a second fastener, and appropriate twisting of the first fastener relative to the second fastener with sufficient force to secure the two fasteners together, without breaking either.

22. The method according to clauses 13-21, wherein the creating of multiple levels comprises using spacers to support components at different levels.

23. The method according to clauses 13-22, wherein the step of selecting comprises selecting predetermined shapes having a through hole, or selecting and cutting raw material into a plurality of desired shapes to create components having a through hole.

The invention claimed is:

1. A kit for assembling a multi-level, three dimensional work comprised of a plurality of components of the kit, the kit comprising:

a plurality of shaped components, each component having a through-hole, a length, a width and a thickness, the through-hole having a perimeter completely within the component and penetrating through the thickness of the component;

a plurality of fasteners each having a shank portion sized to fit through the through-hole of a shaped component, and configured to lock together vertically spaced-apart shaped components, each of the plurality of fasteners having a male connector at a first end and a corresponding female connector at a second, opposing end, wherein the plurality of fasteners are configured to connect to each other end-to-end to thereby provide combination fasteners of fixed length increments;

a plurality of spacers, the spacers configured to mechanically engage either end of the fasteners, the spacers each having a central through-bore configured to receive an end of a fastener, each spacer comprising bore protrusions in its through-bore for engaging corresponding grooves recessed along a shank portion at both ends of a fastener such that engaging spacers may be held at predetermined positions along either end of an engaged fastener by corresponding bore protrusions and recessed grooves, and each spacer having a support surface configured to abut against a surface of a shaped component to support vertically spaced-apart stacked shaped components and to maintain separation between adjacent vertically spaced-apart stacked shaped components in an assembled multi-level, three dimensional work; wherein a support surface of a first spacer mechanically engaged on a first end of a first fastener supports a first surface of a shaped component, and a support surface of a second spacer mechanically engaged on a second end of a second fastener supports a second, opposing surface of the shaped component, when the male connecter of the first fastener is received by the female connector of the second fastener; and a platform for mounting the multi-level, three dimensional work thereto.

2. The kit of claim 1, wherein the plurality of shaped components are white and further comprising a plurality of coloring materials suitable for applying color to the plurality of shaped components.

3. The kit of claim 1, wherein the shaped components are transparent or translucent.

4. The kit of claim 3, further comprising light emitting diodes and optical fiber, the optical fiber carrying light from the light emitting diodes to at least some of the plurality of shaped components in an assembled multi-level, three dimensional work.

5. The kit of claim 4, further comprising a controller programmed to play light displays via the light emitting diodes.

6. The kit of claim 5, further comprising a sound chip providing an audio accompaniment to the light display.

7. The kit of claim 1, further comprising any one or more of a sound chip, a sound sensor and a motion sensor, the motion or sound sensor activating the sound chip in an assembled multi-level, three dimensional work.

8. The kit of claim 1, further comprising base fasteners configured to secure the three dimensional work to the platform, the base fasteners having a non-circular cross section.

9. The kit of claim 1, wherein a first end of a first fastener of the plurality of fasteners frictionally engages a second end of a second fastener, and the first and second ends are mechanically locked together upon twisting the first fastener relative to the second fastener, with appropriate force.

10. The kit of claim 1, further comprising light emitting diodes and optical fiber, the optical fiber carrying light from the light emitting diodes to at least some of the plurality of shaped components in an assembled multi-level, three dimensional work.

11. The kit of claim 10, further comprising a controller programmed to play light displays via the light emitting diodes.

12. The kit of claim 1, wherein the plurality of fasteners comprise fasteners configured to lock together vertically-separated shaped components such that the locked together shaped components are in parallel planes.

13. The kit of claim 1, further comprising blanks for a user to cut and create shaped components.

14. The kit of claim 8, wherein a first end of a base fastener is configured to frictionally engage a second end of a fastener of the plurality of fasteners, and the first and second ends are mechanically locked together upon twisting the base fastener relative to the fastener of the plurality of fasteners, with appropriate force.

15. The kit of claim 1, further comprising a plurality of end caps, each end cap configured to engage and cover an exposed end of a fastener in an assembled multi-level, three dimensional work.

16. The kit of claim 1, wherein the plurality of fasteners comprises press-twist fasteners.

* * * * *